US006922930B1

(12) United States Patent
Grayson

(10) Patent No.: US 6,922,930 B1
(45) Date of Patent: Aug. 2, 2005

(54) DOCUMENT DISPLAYING SYSTEM

(76) Inventor: Thomas Grayson, 510 N. Hampton St., Anaheim, CA (US) 92801

( * ) Notice: Subject to any disclaimer, the term of this patent is extended or adjusted under 35 U.S.C. 154(b) by 29 days.

(21) Appl. No.: 10/638,157

(22) Filed: Aug. 8, 2003

(51) Int. Cl.[7] ..... A47G 1/06
(52) U.S. Cl. ..... 40/711
(58) Field of Search ..... 40/700, 711

(56) References Cited

U.S. PATENT DOCUMENTS

| | | | | |
|---|---|---|---|---|
| 2,785,490 | A * | 3/1957 | Fabry | 40/711 |
| 3,553,872 | A * | 1/1971 | Ebner | 40/711 |
| 3,952,435 | A * | 4/1976 | Olsen | 40/711 |
| 4,583,309 | A * | 4/1986 | Kane et al. | 40/711 |
| 4,785,562 | A * | 11/1988 | Good | 40/711 |
| 4,831,756 | A * | 5/1989 | Huang et al. | 40/711 |
| 5,075,991 | A | 12/1991 | Wenkman et al. | |
| 5,158,295 | A * | 10/1992 | Shilling | 40/711 |
| 5,167,087 | A | 12/1992 | Plumly | |
| 5,195,263 | A | 3/1993 | Huang | |
| 5,303,489 | A | 4/1994 | Blegen | |
| 5,303,493 | A | 4/1994 | Plumly | |
| 5,309,659 | A | 5/1994 | Eastman | |
| 5,363,579 | A | 11/1994 | Plumly | |
| 6,052,933 | A | 4/2000 | Lytle | |
| 6,308,446 | B1 | 10/2001 | Healy | |
| 2003/0121193 | A1 * | 7/2003 | Kim | 40/711 |

* cited by examiner

*Primary Examiner*—Gary C. Hoge

(57) ABSTRACT

A document displaying system for facilitating easy access to documents being displayed. The document displaying system includes a support assembly having a backing member selectively couplable to a vertical support surface; a frame assembly operationally couplable to the support assembly; a transparent cover member operationally couplable to the frame assembly, and abutting a perimeter edge of the transparent cover member; and a pair of magnetic coupling members for selectively operationally securing the transparent cover member to the support assembly.

11 Claims, 5 Drawing Sheets

DOCUMENT DISPLAYING SYSTEM

BACKGROUND OF THE INVENTION

1. Field of the Invention

The present invention relates to document displaying devices and more particularly pertains to a new document displaying system for facilitating easy changing of documents to be displayed.

2. Description of the Prior Art

The use of document displaying devices is known in the prior art. U.S. Pat. No. 5,303,493 describes a device for displaying advertising in a floor surface. Other examples of document displaying devices include U.S. Pat. No. 6,308,446; U.S. Pat. No. 5,309,659; U.S. Pat. No. 5,195,263; U.S. Pat. No. 5,167,087; U.S. Pat. No. 5,363,597; U.S. Pat. No. 6,052,933; U.S. Pat. No. 5,303,489; and U.S. Pat. No. 5,075,991.

While these devices fulfill their respective, particular objectives and requirements, the need remains for a system that provides for additional stability of a frame, support of the system's weight, and easy front access to the document being displayed.

SUMMARY OF THE INVENTION

The present invention meets the needs presented above by utilizing an intermediate member which is positionable in the frame assembly between the transparent cover member and the backing member to aid the frame in both retaining its shape and transferring at least a portion of the frame assemblies weight to the vertical support surface to which the system is coupled.

Another object of the present invention is to provide a new document displaying system that provides a coupling mechanism, which is hidden from view to reduce tampering with the document being displayed.

Still another object of the present invention is to provide a new document displaying system that has a grove along the top back edge of the system adjacent to the vertical support surface to assist in accessing the document by providing room for the frame to be moved and accessed by the user.

To this end, the present invention generally comprises a support assembly having a backing member selectively couplable to a vertical support surface; a frame assembly operationally couplable to the support assembly; a transparent cover member operationally couplable to the frame assembly, and abutting a perimeter edge of the transparent cover member; and a pair of magnetic coupling members for selectively operationally securing the transparent cover member to the support assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
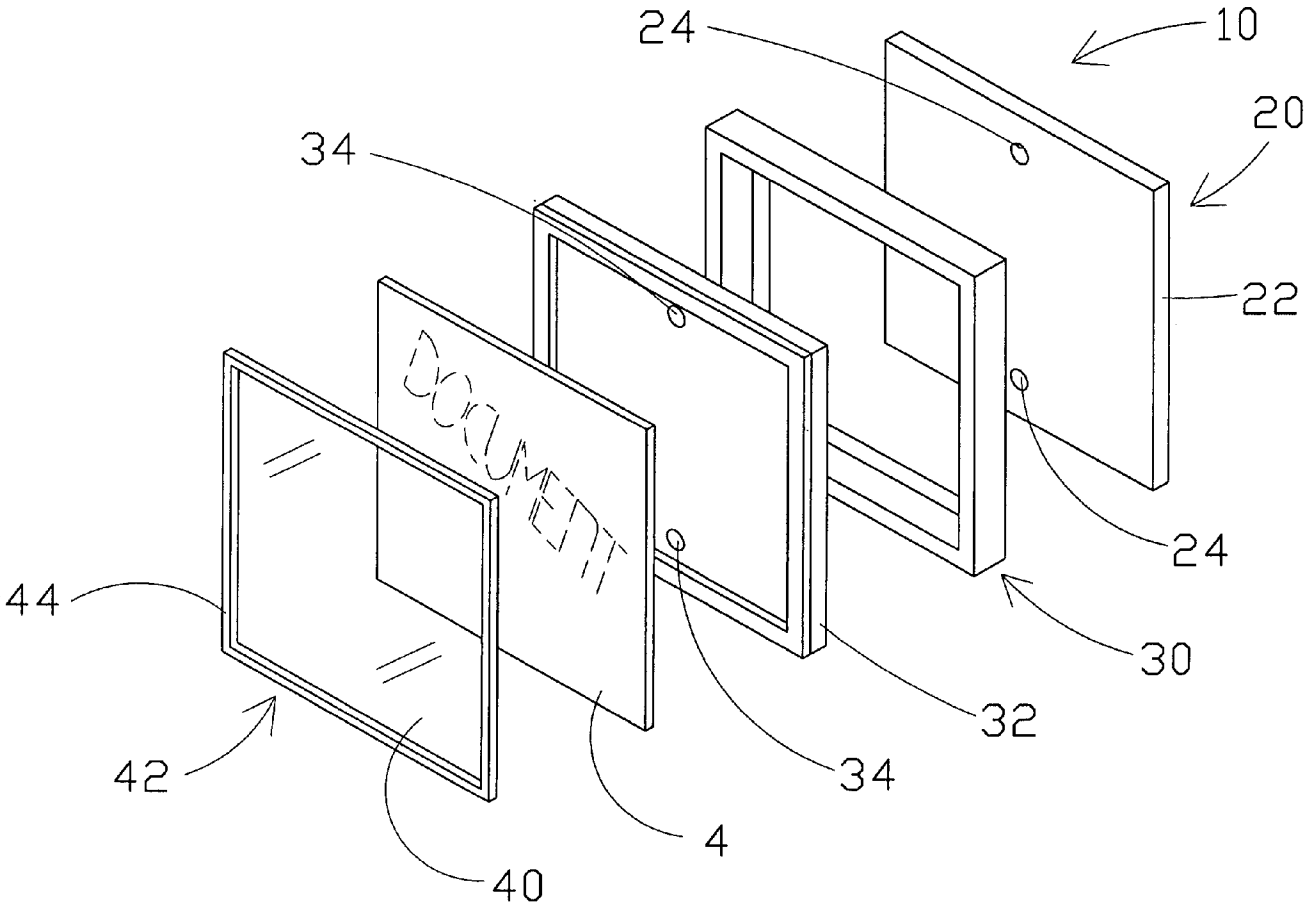
FIG. 1 is a schematic perspective exploded view of a new document displaying system according to the present invention.
Figure 2:
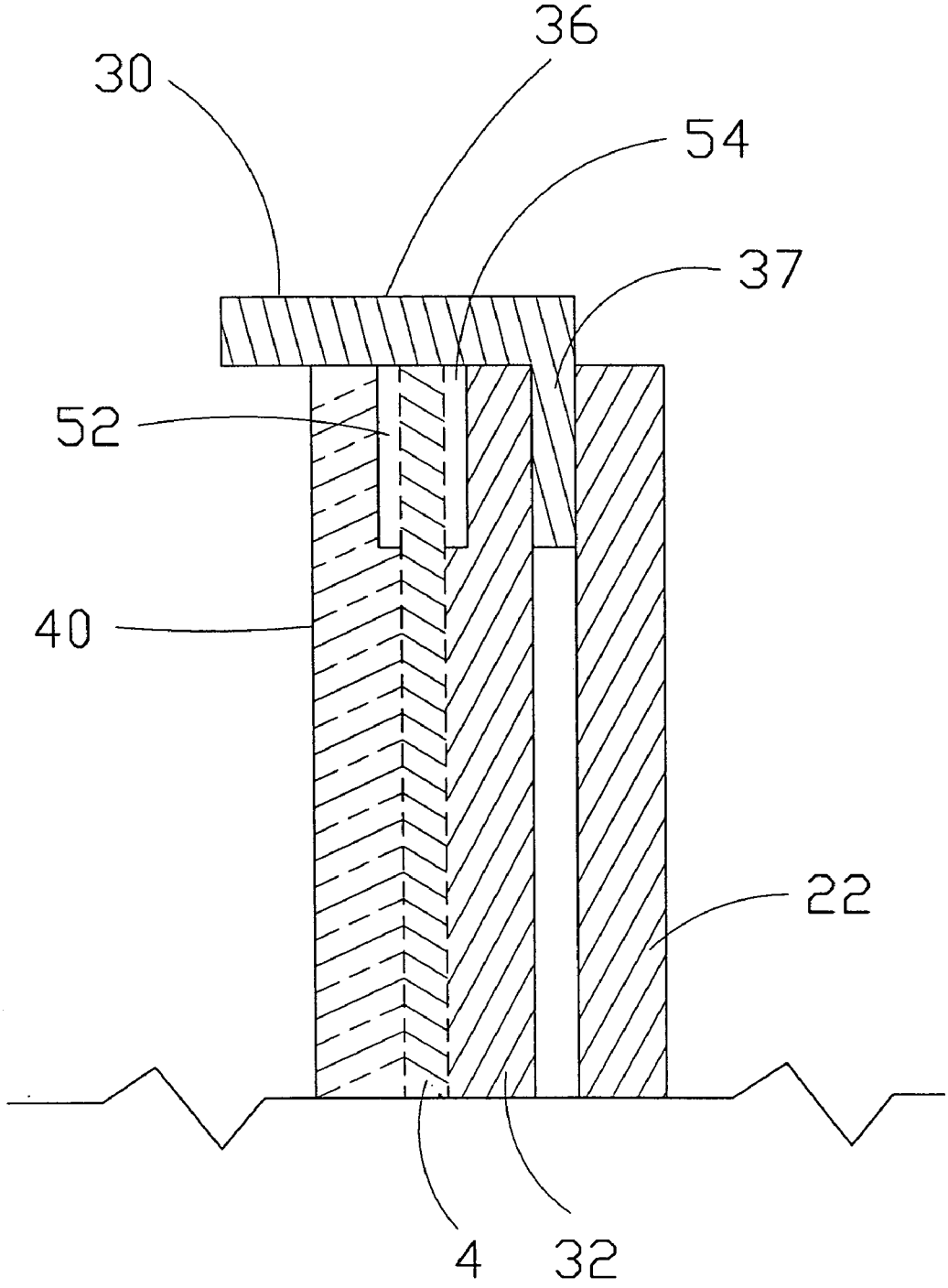
FIG. 2 is a schematic cross-sectional view of the present invention.
Figure 3:
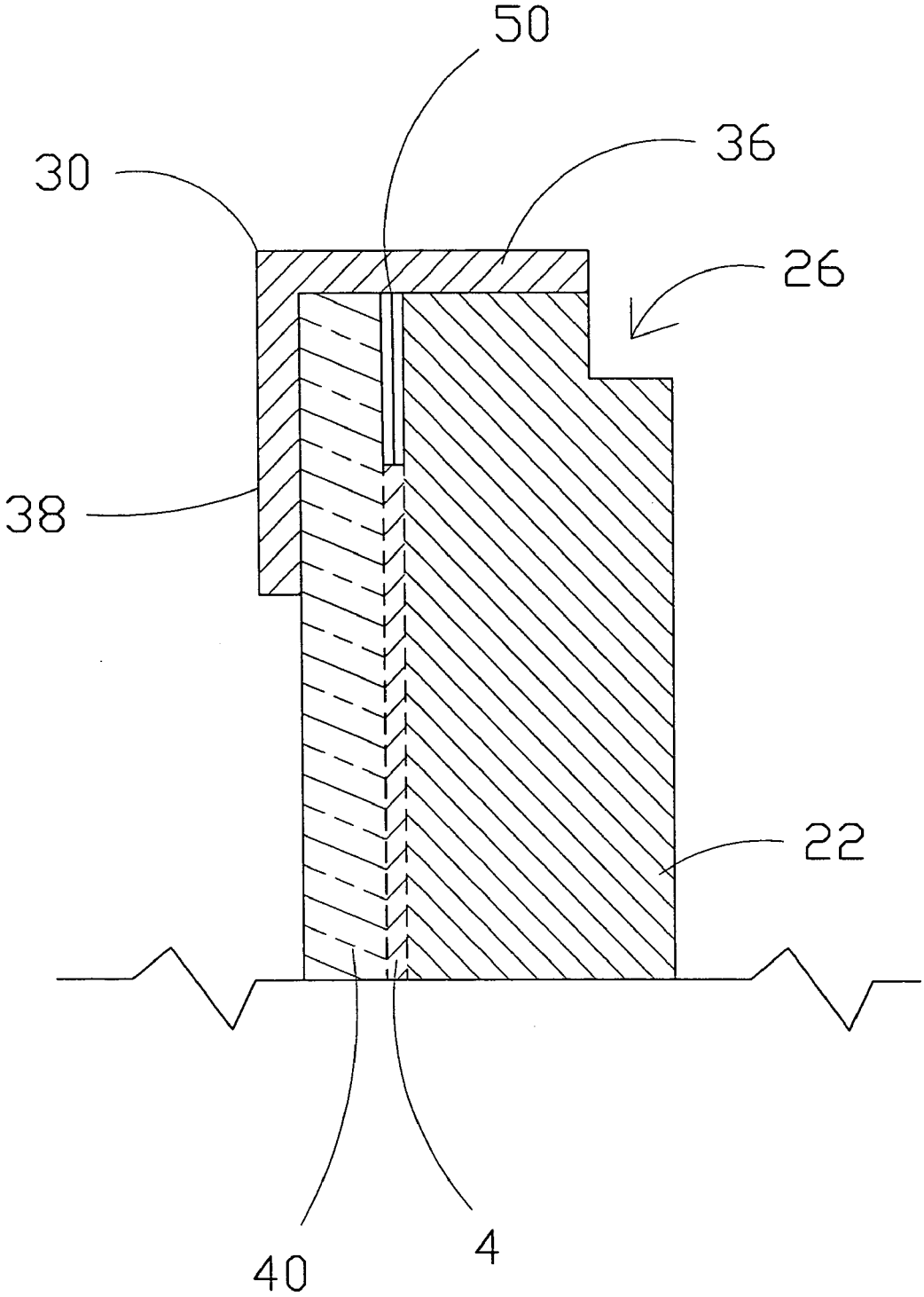
FIG. 3 is a schematic cross-sectional side view of an embodiment of the present invention.
Figure 4:
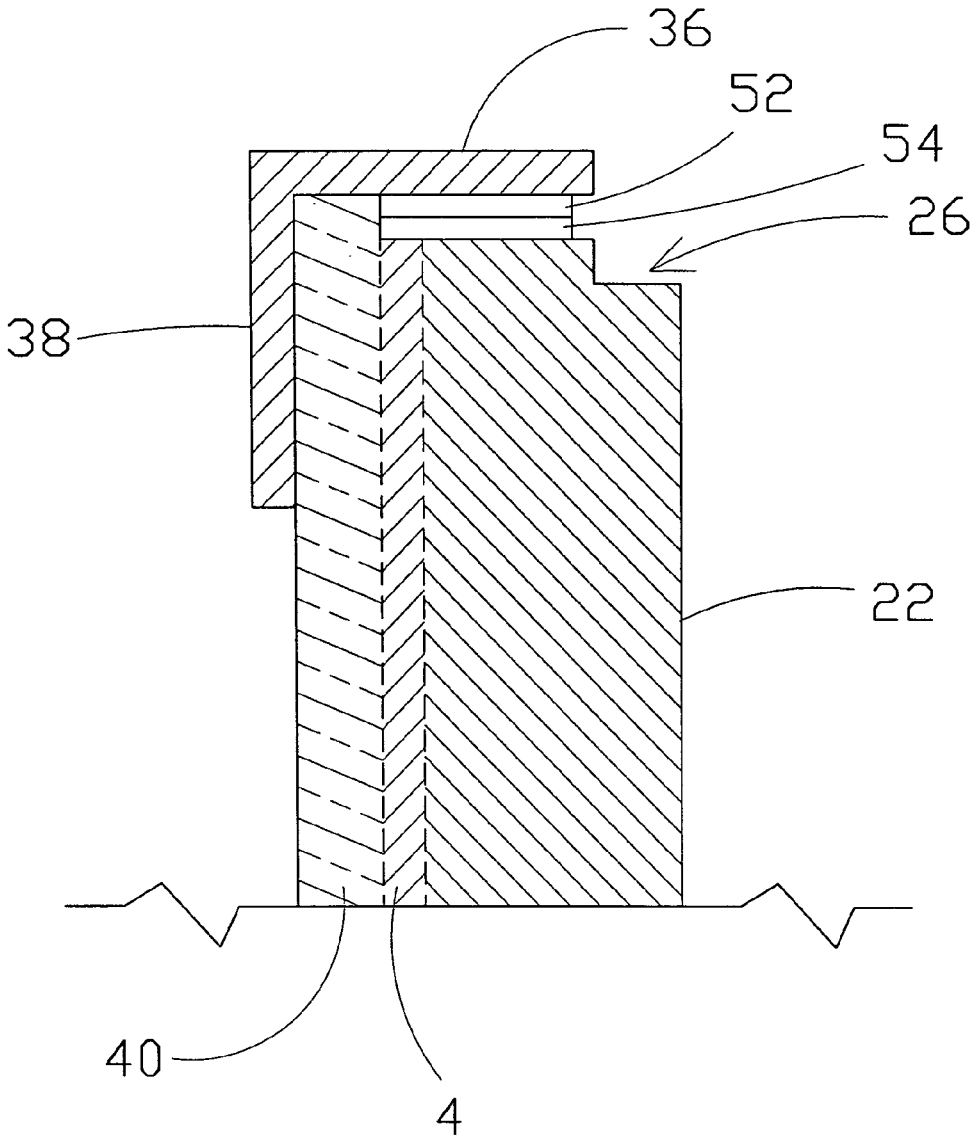
FIG. 4 is a schematic cross-sectional view of the present invention.
Figure 5:
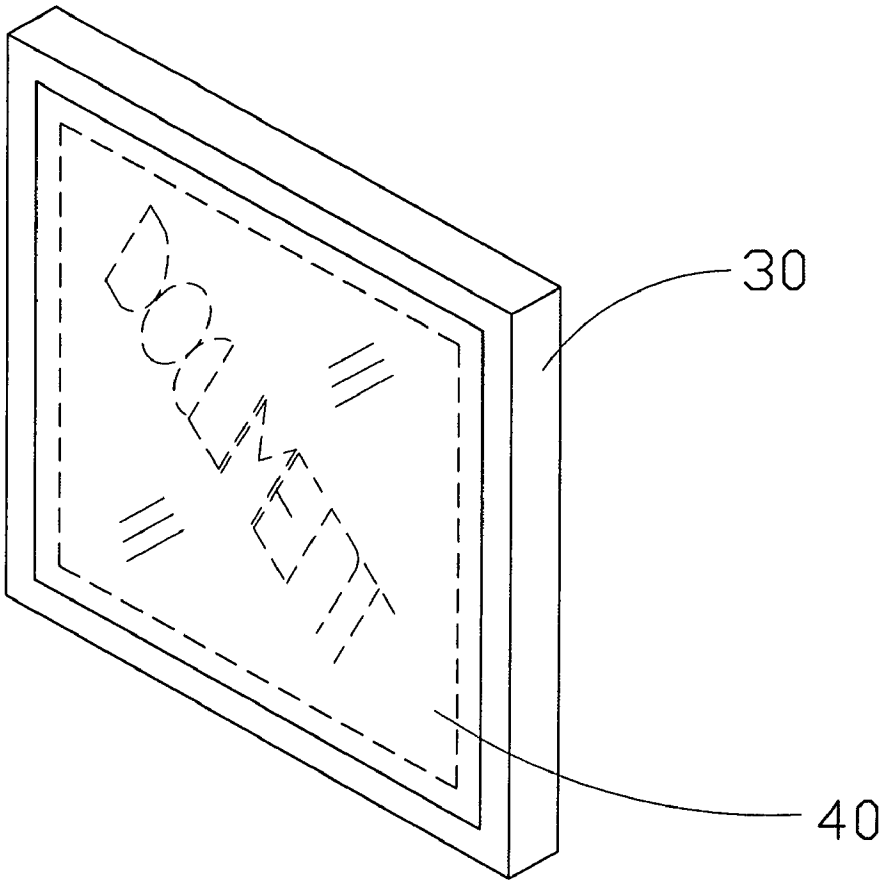
FIG. 5 is a schematic perspective view of the present invention.

With reference now to the drawings, and in particular to FIGS. 1 through 5 thereof, a new document displaying system embodying the principles and concepts of the present invention and generally designated by the reference numeral 10 will be described.

As best illustrated in FIGS. 1 through 5, the document displaying system 10 generally comprises a support assembly 20, a frame assembly 30, a transparent cover member 40, and a pair of magnetic coupling members 50.

The support assembly 20 includes a backing member 22 which is selectively couplable to a vertical support surface 2 such as a wall. The frame assembly 30 is operationally couplable to the support assembly 20. The transparent cover member 40 is operationally couplable to the frame assembly 30. The frame assembly 30 abuts a perimeter edge of the transparent cover member 42. The transparent cover member 40 is for protecting a document 4 to be displayed. The pair of magnetic coupling members 50 is for selectively operationally securing the transparent cover member 40 to the support assembly 20.

Preferably, an intermediate board member 32 is positionable in the frame assembly 30 between the support assembly 20 and the transparent cover member 40. The intermediate board member 32 provides support for the frame assembly 30 and aids the frame assembly 30 in retaining its shape.

In a preferred embodiment, at least one back mounting aperture 24 extends through the backing member 22 for facilitating securing the support assembly 20 to the vertical support surface 2. More preferably two back mounting apertures 24 are used to inhibit the system 10 from pivoting across the vertical support surface 2.

At least one intermediate mounting aperture 34 may extend through the intermediate board member 32. The intermediate mounting aperture(s) 34 is aligned with the back mounting aperture(s) 24 for facilitating securing the intermediate board member 32 to the vertical support surface 2. Thus, a portion of the weight of the frame assembly 30 is supported by the intermediate board member 32.

In an embodiment the transparent cover member 40 includes an opaque portion 44 extending around a perimeter edge 42 of the transparent cover member 40. The opaque portion 44 provides an appearance of a matt around the document 4 being displayed. The opaque portion 44 may also conceal the magnetic coupling members 50 from view when the system 10 is fully assembled.

In a further embodiment the frame assembly 30 further comprises a side portion 36 and a back portion 37. The side portion 36 is for encompassing a perimeter edge 42 of the transparent cover member 40. The back portion is 37 coupled to the side portion 36. The back portion 37 is positionable between the backing member 22 and the transparent cover member 40.

In a preferred embodiment the frame assembly 30 further comprises a side portion 36 and a front portion 38. The side portion 36 is for encompassing a perimeter edge 42 of the transparent cover member 40. The front portion 38 is coupled to the side portion 36. The front portion 38 abuts a front edge of the transparent cover member 40 for assisting in selectively coupling the transparent cover member 40 to the support assembly 20.

In a further embodiment a first one 52 of the pair of magnetic coupling members 50 is operationally coupled to the transparent cover member 40 and a second one 54 of the pair of magnetic coupling members 50 is operationally coupled to the backing member 22. Thus the transparent cover member 40 is selectively securable to the backing member 22.

In another embodiment a first one 52 of the pair of magnetic coupling member 50 is operationally coupled to the frame assembly 30 and a second one 54 of the pair of magnetic coupling members 50 is operationally coupled to the backing member 22. Thus the frame assembly 30 is selectively securable to the backing member 22.

In even still a further embodiment the backing member 22 has a groove 26 extending along a back top edge providing a space between the frame assembly 30 an the vertical support surface 2 when the frame assembly 30 is coupled to the backing member 22.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A document displaying system comprising:

a support assembly having a backing member selectively couplable to a vertical support surface;

a frame assembly operationally couplable to said support assembly;

a transparent cover member operationally couplable to said frame assembly, said frame assembly abutting a perimeter edge of said transparent cover member, said transparent cover member being for protecting a document to be displayed;

a pair of magnetic coupling members for selectively operationally securing said transparent cover member to said support assembly;

an intermediate board member positionable in said frame assembly between said support assembly and said transparent cover member, said intermediate board member providing support for said frame assembly and aiding said frame member in retaining its shape;

at least one back mounting aperture extending through said backing member for facilitating securing said support assembly to the vertical support surface; and at least one intermediate mounting aperture extending through said intermediate board member, said intermediate mounting aperture being asligned with said back mounting aperture for facilitating securing said intermediate board member to the vertical support surface whereby a portion of the weight of said frame assembly is supported by said intermediate board member.

2. The system of claim 1, wherein said transparent cover member includes an opaque portion extending around a perimeter edge of said transparent cover member, said opaque portion providing an appearance of a matt around the document being displayed.

3. The system of claim 1, further comprising at least one back mounting aperture extending through said backing member for facilitating securing said support assembly to the vertical support surface.

4. The system of claim 1, wherein said frame assembly further comprises:

a side portion for encompassing a perimeter edge of said transparent cover member; and a back portion coupled to said side portion, said back portion being positionable between said backing member and said transparent cover member.

5. A document displaying system comprising:

a support assembly having a backing member selectively couplable to a vertical support surface;

a frame assembly operationally couplable to said support assembly;

a transparent cover member operationally couplable to said frame assembly, said frame assembly abutting a perimeter edge of said transparent cover member, said transparent cover member being for protecting a document to be displayed;

a pair of magnetic coupling members for selectively operationally securing said transparent cover member to said support assembly;

an intermediate board member positionable in said frame assembly between said support assembly and said transparent cover member, said intermediate board member providing support for said frame assembly and aiding said frame member in retaining its shape;

at least one back mounting aperture extending through said backing member for facilitating securing said support assembly to the vertical support surface; and at least one intermediate mounting aperture extending through said intermediate board member, said intermediate mounting aperture being aligned with said back mounting aperture for facilitating securing said intermediate board member to the vertical support surface whereby a portion of the weight of said frame assembly to supported by said intermediate board member.

6. The system of claim 5, wherein said transparent cover member includes an opaque portion extending around a perimeter edge of said transparent cover member, said opaque portion providing an appearance of a matt around the document being displayed.

7. The system of claim 5, wherein said frame assembly further comprises:

a side portion for encompassing a perimeter edge of said transparent cover member; and a back portion coupled to said side portion, said back portion being positionable between said backing member and said transparent cover member.

8. The system of claim 5, wherein said frame assembly further comprises:

a side portion for encompassing a perimeter edge of said transparent cover member; and a front portion coupled to said side portion, said front portion abutting a front edge of said transparent cover member for assisting in selectively coupling said transparent cover member to said support assembly.

9. The system of claim 8, wherein a first one of said pair of magnetic coupling members is operationally coupled to said transparent cover member and a second one of said pair of magnetic coupling members is operationally coupled to said backing member whereby said transparent cover member is selectively securable to said backing member.

10. The system of claim 8, wherein a first one of said pair of magnetic coupling member is operationally coupled to said frame assembly and a second one of said pair of magnetic coupling member is operationally coupled to said backing member whereby said frame assembly is selectively securable to said backing member.

11. The system of claim 5, wherein said backing member has a groove extending along a back top edge providing a space between said frame assembly an the vertical support surface when said frame assembly is coupled to said backing member.

* * * * *